United States Patent [19]

Day

[11] Patent Number: 4,799,452

[45] Date of Patent: Jan. 24, 1989

[54] LIQUID TONER RECYCLING SYSTEM AND METHOD

[75] Inventor: Gene F. Day, Hillsborough, Calif.

[73] Assignee: Precision Image Corporation, Redwood City, Calif.

[21] Appl. No.: 77,104

[22] Filed: Jul. 23, 1987

[51] Int. Cl.[4] ..... G03G 15/10; G03G 21/00; B03C 5/02; B05C 11/10

[52] U.S. Cl. ..... 118/645; 118/647; 118/660; 118/603; 204/302; 209/127.1; 209/130; 210/748; 346/157; 355/4; 355/10

[58] Field of Search ..... 209/127.1, 128–130; 204/186, 302, 304, 300 R; 355/4, 10; 118/603, 645, 659, 660, 647; 210/748; 346/157; 430/45, 114, 137

[56] References Cited

U.S. PATENT DOCUMENTS

| | | | |
|---|---|---|---|
| Re. 29,818 | 10/1978 | Gerbasi et al. . | |
| 960,470 | 6/1910 | Wentworth | 209/130 |
| 3,129,115 | 4/1964 | Clark et al. | 355/10 X |
| 3,249,225 | 5/1966 | Stuetler et al. | 209/129 |
| 3,655,550 | 4/1972 | Davies | 209/129 X |
| 3,662,884 | 5/1972 | Robinson | 209/129 |
| 3,790,466 | 2/1974 | Akiyama | 204/300 |
| 3,799,390 | 3/1974 | Tamai et al. | 209/127.1 |
| 3,816,157 | 6/1974 | Donohue et al. | 430/137 |
| 3,870,644 | 3/1975 | Machida et al. | 430/45 X |
| 3,900,003 | 8/1975 | Sato et al. | 355/10 X |
| 3,910,231 | 10/1975 | Inoue et al. | 355/4 X |
| 3,924,566 | 12/1975 | Dennie . | |
| 3,962,069 | 6/1976 | Inoue et al. | 210/748 X |
| 4,052,298 | 10/1977 | Bradley | 209/5 |
| 4,110,029 | 8/1978 | Goshima et al. | 355/10 |
| 4,236,317 | 12/1980 | Candor | 204/300 R X |
| 4,351,604 | 9/1982 | Karasawa et al. | 355/4 |
| 4,449,475 | 5/1984 | Schinke | 118/645 |
| 4,571,071 | 2/1986 | Bothner | 355/4 X |
| 4,706,605 | 11/1987 | Bibl et al. . | |

FOREIGN PATENT DOCUMENTS

| | | | |
|---|---|---|---|
| 54-143131 | 11/1979 | Japan | 430/114 |

*Primary Examiner*—James B. Marbert
*Assistant Examiner*—Edward M. Wacyra
*Attorney, Agent, or Firm*—Thomas Schneck

[57] ABSTRACT

A toner recycling system having separate supply tank of clear liquid dispersant and tanks of color concentrate. The liquid dispersant is continuously circulated from its supply tank by a pump along lines to a toner applicator then back to the supply tank. Color concentrate containing charge bearing solid pigment particles are selectively injected and mixed with the dispersant by means of pumps or valves to form liquid toner whenever developing a latent image is desired. The excess toner is collected and sent to a solids separator, either dedicated to a particular color of toner or common to all toners, where an electrically biased electrode repels the solid pigment particles toward a particle accumulating surface, thereby separating the particles from the dispersant. The dispersant is returned to the supply tank, while the particles which have accumulated on the surface of either a drum or belt as a layer of concentrate is scraped off by a blade and returned to the appropriate tank.

31 Claims, 3 Drawing Sheets

LIQUID TONER RECYCLING SYSTEM AND METHOD

DESCRIPTION

1. Technical Field

The present invention relates to electrographic printing and in particular to systems and methods of dispensing, circulating, using and reusing liquid toners in electrographic printers and electrophotographic copiers and printers.

2. Background Art

In electrographic printing and copying, toner compositions are applied to an electrostatic latent image formed on a dielectric surface in order to develop, i.e. make visible, the image. The dielectric surface may be a coating on a sheet or web of paper to which the toner is applied. Alternatively, the dielectric surface may be the charge retentive surface of a drum, belt or the like from which toner applied thereto is transferred to a sheet or web of plain paper. The electrostatic latent image may be established through electrostatic induction by a charged writing head, by ion projection, or through photoconduction, as in electrophotographic copiers. Typically, the toner composition is a liquid toner composed of pigments or dyestuffs combined with a plastic or resinous binder, hereafter called "solid pigment particles" or "colorant", with very small amounts of added charge control agents, and dispersed in a large volume of liquid dispersant, primarily composed of a solvent. One common solvent used in liquid toners is an isoparaffinic hydrocarbon available under the tradename ISOPAR from the Exxon Corporation.

Multi-color electrostatic printers typically store liquid toner in storage tanks, one for each desired color, and selectively dispense the toner to one or more applicators as it is needed. Usually, any excess toner is returned to the appropriate supply tank for reuse. Because pigment particles are deposited in the printing process to the latent image, the excess toner returned to the supply tanks quickly dilutes the supply of toner until it becomes so dilute that it must be replenished. A concentrated form of the colorant is periodically added to the tank to restore the colorant removed by the toning process. Liquid toners have a very delicate chemical balance which is easily upset by ageing, excess replenishment, contamination, color intermixing, selective constituent removal during electrophoretic toning, or simply heavy use. If the chemical balance is lost, poor imaging results and the entire contents of the tank or tanks must be replaced. The poor imaging is manifested as smearing, streaking, background staining, and loss of color saturation in various combinations thereof. Thus, despite many advantages that liquid toning has over other marking methods, large volumes of combustible liquid must be loaded into the machine, used for image processing and disposed of by the user without causing environmental contamination. Further, as the chemical balance of the toner varies with use, the contrast and color balance of the finished product, i.e. the printed sheet, may vary unacceptably if the toner supply or supplies are not periodically replaced.

In U.S. Pat. No. 4,052,298, Bradley discloses a method of treating toner compositions in order to separate the pigment particles and liquid dispersant. The liquid toner is uniformly dispersed or emulsified in water, preferably with the aid of a detergent. Next, an extractant mixture comprising a normally liquid hydrocarbon mineral spirit with a small amount of a charge control agent is introduced onto the surface of the water-toner emulsion. Charge responsive colorant is thereby attracted to the boundary between the emulsion and extractant, and agglomerates thereat. Finally, the agglomeration and extractant are physically separated from the remaining water-solvent emulsion, by skimming, decantation or similar means. The toner solvent may be recovered from the emulsion and the colorant may be recovered from the extractant mineral spirit for reuse. The entire process is described as taking about an hour to complete.

In U.S. Pat. No. 4,351,604, Karasawa et al. describe a multicolor electrostatic copier in which a bipolar electrostatic image on a dielectric member is sequentially developed by dry powder toners of first and second different colors and of opposite charge. A small amount of the first toner is scraped off the dielectric member during the second developing step and becomes mixed with the second toner. In order to prevent a color degrading accumulation of first toner in the supply of second toner, the copier is provided with a separation member in the form of a roller, belt or mesh covered electrode which is charged to a polarity opposite to the first toner. The separation member thereby electrostatically attracts the first toner while repelling the second toner so as to separate and remove admixed first toner from the second toner.

It is an object of the present invention to provide a toner recycling system and method which eliminates the handling of large volumes of toner fluid.

DISCLOSURE OF THE INVENTION

The above object has been met with a solids separation method and with a toner recycling system having at least one tank of color concentrate containing charge bearing solid pigment particles, and a separate supply tank of clear fluid dispersant, in which dispersant is continuously circulated from the supply tank to an applicator and back to the supply tank, and in which a selected color concentrate is injected and mixed in the dispersant whenever toning is desired. The system also includes a solid separator which electrically separates charge bearing solid pigment particles from excess toner fluid collected by a drain immediately following toner application. The pigment particles are returned to the appropriate color concentrate tank, while the clear fluid dispersant is returned to the supply tank. When any particular toner application step is completed, the concentrate injection is stopped and flow of clear dispersant resumes, providing automatic cleaning of the applicator.

A solids separation method is carried out by the solids separator which includes an electrode, a particle accumulating surface moving past the electrode and a scraper blade for removing pigment particles from the particle accumulating surface. The toner fluid is introduced at one end of the region defined between the electrode and the particle accumulating surface and is either carried or pumped to an exit aperture at the other end of the region. The electrode is biased to repel the charge bearing solid pigment particles, so that the particles are deposited on the particle accumulating surface. Substantially particle free liquid dispersant remains and is removed at the exit aperture and returned to its supply tank. The scraper blade abuts against the particle accumulating surface so as to remove the agglomeration of particles from the particle accumulating surface. This color concentrate is returned to the appropriate tank.

An advantage of the invention is that there is no need to handle or dispose of premixed toners. The user would simply add color concentrate whenever any tank runs low. Occasionally, dispersant would also need to be added. Another advantage is that greater color consistency is obtained, since the concentration of pigment particles in the toner fluid remains substantially constant. Yet another advantage is that the chemical balance of the toners is more easily maintained.

BEST MODE FOR CARRYING OUT THE INVENTION

Figure 1:
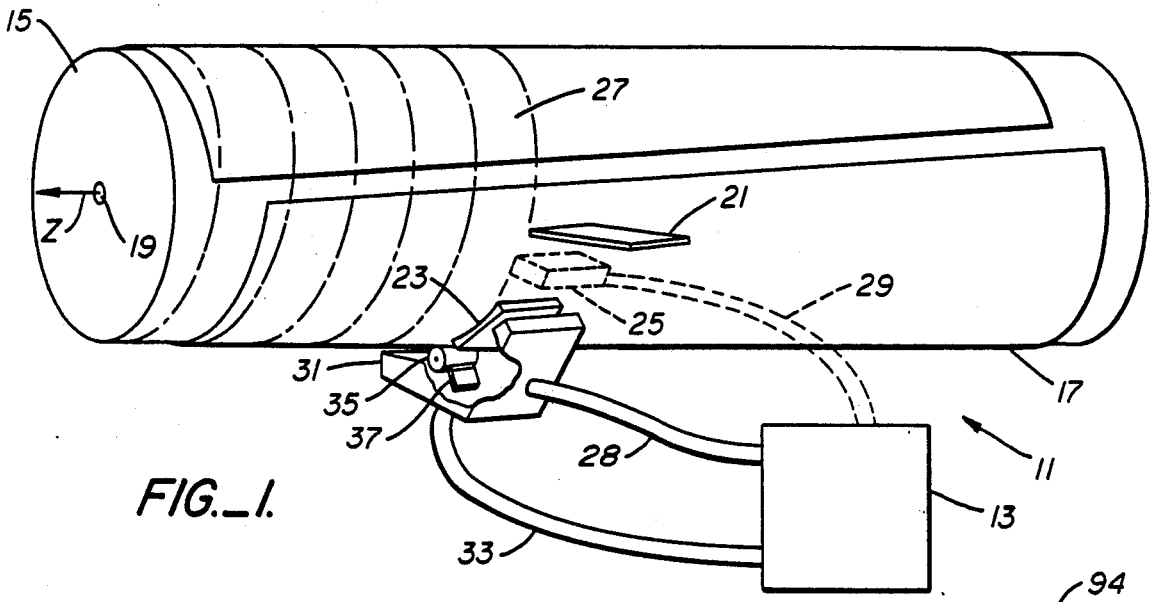
FIG. 1 is a perspective view of an electrostatic printer employing the toner recycling system of the present invention.

With reference to FIG. 1, the present invention provides a toner recycling system 13 for use with electrostatic printers 11. However, the toner recycling system 13 can also be used for developing nonelectrostatic media. In the electrostatic printer 11, a drum 15 supports a sheet of paper 17 for rotation. An axle 19 located on the longitudinal axis Z through the center of drum 15 supports the drum and transmits rotational energy from a motor, not shown. The size of drum 15 may vary, a large size drum typically having a diameter of approximately 12 inches and a width of approximately 52 inches. Sheet 17 is coated so that it is a charge retaining dielectric medium. Such sheets are commercially available, for example "Electrographic Paper" sold by James River Corporation. Alternatively, a latent image may be formed and developed directly on drum 15, and the developed image transferred to a sheet of plain paper.

An electrostatic head 21, for creating an electrostatic latent image, is in mechanical contact with the sheet 17, applying charge thereto. The head may comprise a linear array of wires forming charging elements, the forward edge of which is in very close proximity to the sheet 17. Head 21 is typically only a fraction of the width of a sheet and is translated laterally, parallel to the longitudinal axis Z of the drum 15 so that a helical stripe pattern 27, indicated by dashed lines, is traced on the sheet. Alternatively, head 21 may be a full width head which is fixed in position. The number of wires in a head may range from 100 to 20,000. The charging elements are at a negative potential of 400 to 600 volts relative to a drum at ground or at a positive potential. Polarities may be reversed.

A toner applicator 23 following head 21 applies liquid toner for developing a latent image existing in the charge pattern deposited on the sheet 17. The latent image created by the head 21 is thus formed into a visible image. Applicator 23 may be a toning shoe, as shown, which supplies the fluid toner locally to the sheet along the helical stripe pattern 27, or alternatively, may be a full drum width toning fountain or pool applicator. A prewet station 25, between the head 21 and the applicator 23 may be included to wet the latent image prior to toning with clear fluid dispersant, such as ISOPAR. This can enhance toning contrast and greatly reduce background marking.

Liquid toner is supplied to applicator 23 from the toner recycling system 13 of the present invention, discussed below, through an inlet tube 28. Likewise, if desired, clear dispersant may be supplied to the prewet station 25 from the toner recycling system 13 through a second inlet tube 29. Excess toner falls into a sump at the bottom of housing 31 for collection and return through drain tube 33 and the toner recycling system 13. A drying roller 35 is seen to also be carried within housing 31 and contacts drum 15 for removing excess developer. Once the excess is removed, it is scraped from the drying roller by a blade 37. Again, excess developer is collected and returned to the toner recycling system 13.

Figure 5:
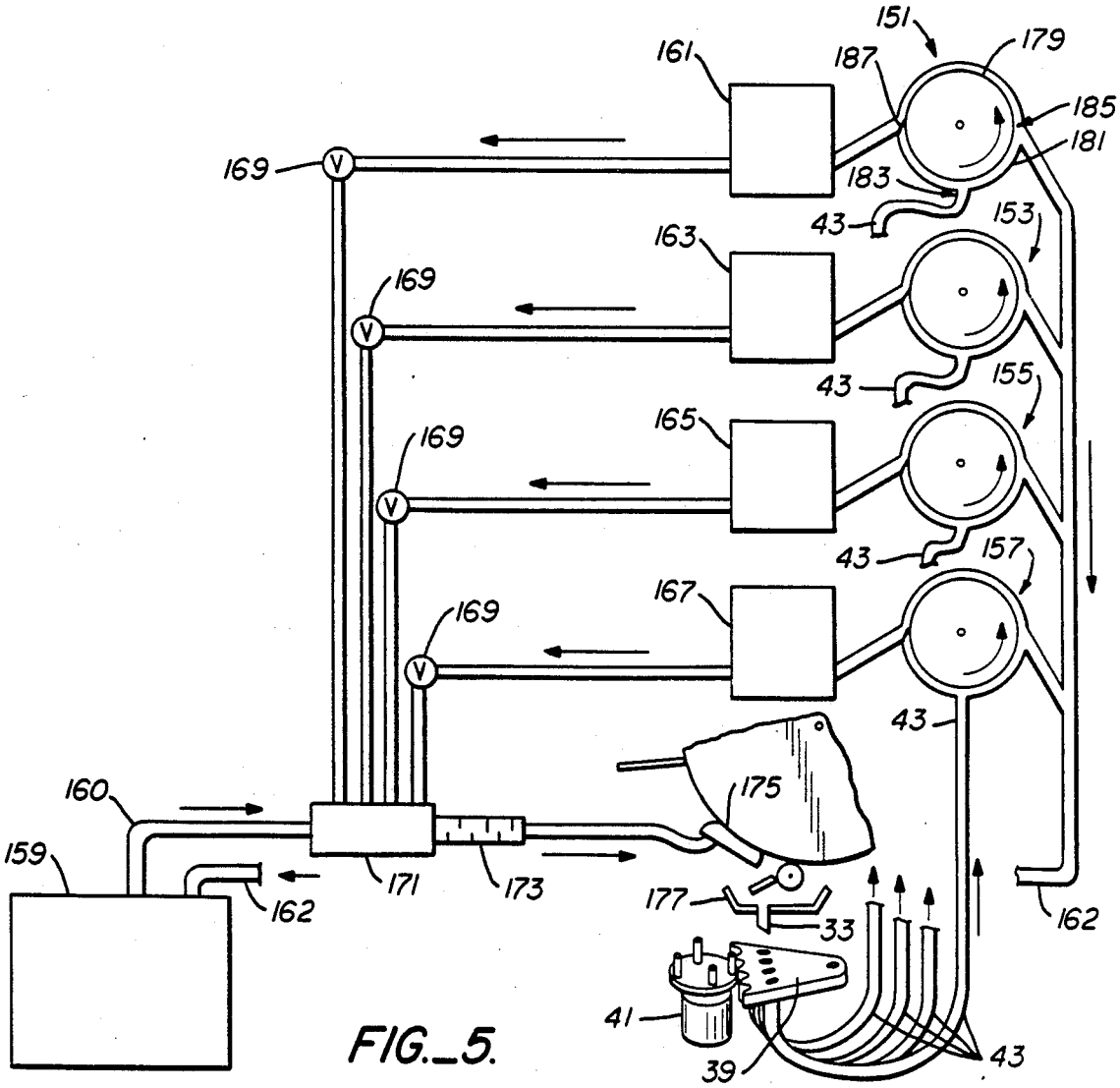
FIG. 5 is a schematic view of an alternate embodiment of a toner recycling system of the present invention employing multiple solids separators.

The toner recycling system 13 typically includes a solids separator for separating pigment particles from the liquid dispersant component of the toner. Such a separator is capable of handling each color of liquid toner successively. Alternatively, the toner recycling system 13 may include a plurality of separate solids separators dedicated to each of the colors of liquid toner, as seen in FIG. 5. In the latter case, a drain selector foot 39 may be used to direct a particular color of excess toner to the appropriate solids separator. A motor 41 causes foot 39 to pivot so that an appropriate return tube 43, each leading to a different solids separator, is postioned under drain tube 33. Alternatively, four toner applicators, each with its own inlet and return lines, may be provided.

Figure 2:
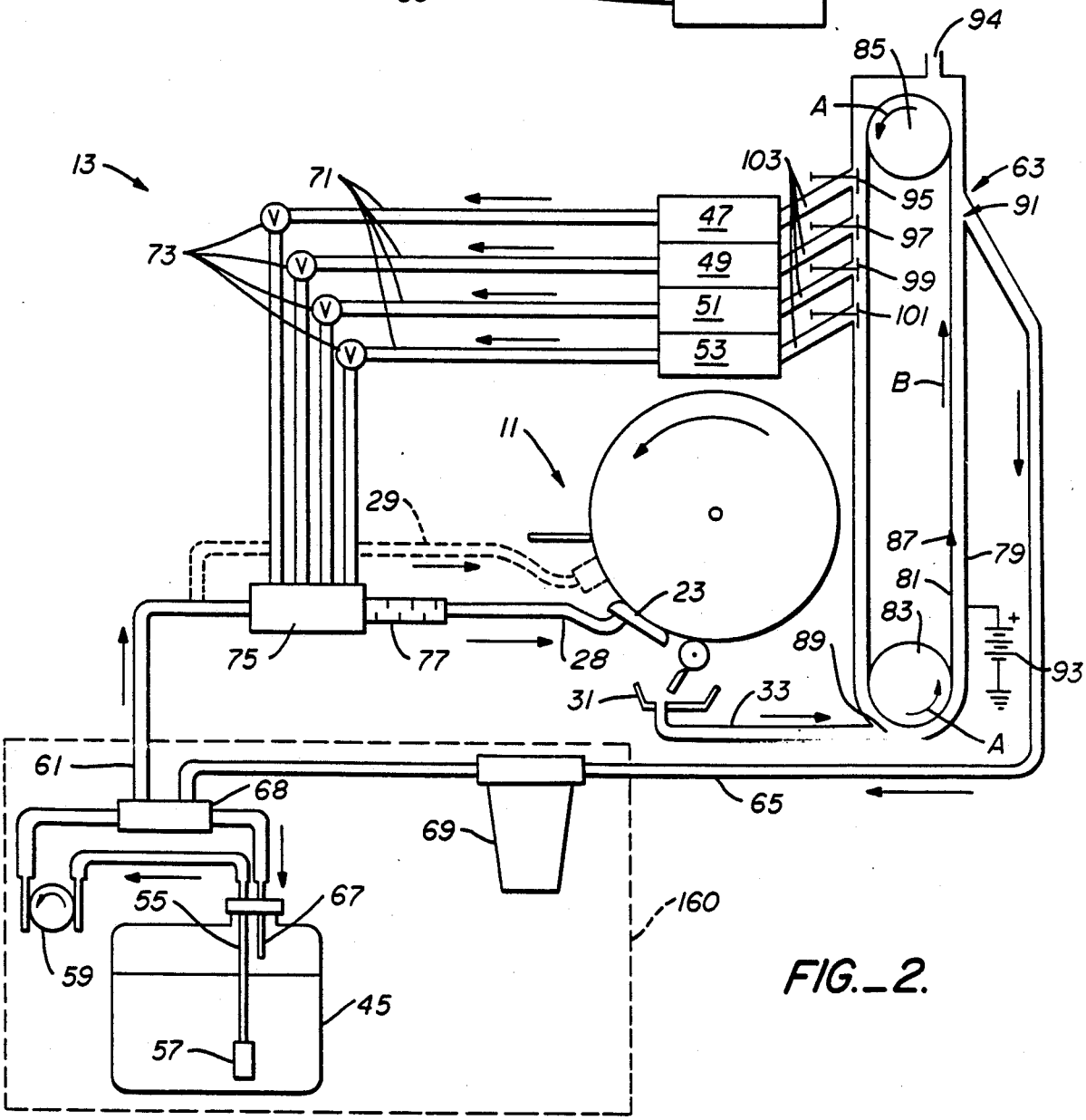
FIG. 2 is a schematic view of the toner recycling system of the present invention including a solids separator carrying out a method of the present invention for separating pigment particles from toner.

With reference to FIG. 2, a toner recycling system 13 of the present invention, for use with electrostatic printers 11 and the like, is seen to include a supply tank 45 and a plurality of tanks 47, 49, 51 and 53 of color concentrate. The dispersant is primarily composed of a solvent such as ISOPAR. ISOPAR is a registered trademark of Exxon Co. for a narrow cut isoparaffinic petroleum solvent consisting predominantly of C10 and C11 isoparaffinic hydrocarbons. Other solvents may also be used. The color concentrate contains charge bearing solid pigment particles, typically composed of a pigment or dyestuff coated or mixed with a plastic or resinous binder. Either the dispersant or the color concentrate or both may contain a small amount of charge control agent. Preferably, the dispersant and the liquid phase of the concentrates all contain the same concentration of charge control agent.

Dispersant is pumped from supply tank 45 through an outlet 55 extending into supply tank 45 and terminating in a particle filter 57. Filter 57 is optional. Pumping is performed by a pump 59 which causes dispersant to be sucked up outlet 55 and sent along a feed line 61 toward the inlet tube 28 of applicator 23. An inlet tube 29 to an optional prewet station may branch off of feed line 61. Excess toner or dispersant is collected by a sump 31 which communicates via drain tube 33 with a solids separator 63. After any solid pigment particles have been separated, the dispersant returns to supply tank 45 via a return line 65 and a tank inlet 67. An aspirator 68 between feed and return lines 61 and 65 provides pressure to feed line 61 and suction to return line 65 to aid circulation. A filter 69 may be placed along the return line 65 to filter out any remaining particles from the dispersant. By this means, i.e. pump 59 and associated lines 55, 61, 28, 33, 65 and 67, a stream of dispersant is continuously circulated from the supply tank 45 to a toner fluid applicator 23 and back to the supply tank.

A set of concentrate feed lines 71 lead from the concentrate tanks 47, 49, 51 and 53 through injectors 73, which may be either injectors, valves or pumps, to an injection body or manifold 75 in the path of the circulating dispersant. Injectors 73 selectively inject an amount of a color concentrate into the stream of dispersant, by means of a particular valve opening or pump actuating or both. The amount of concentrate injected into the stream of dispersant may be controlled by varying the degree of valve opening or by varying the rate of pumping. Typically, the concentrate has a solids content in a range from 25–40% by volume. A mixer 77 between injector body 75 and applicator inlet tube 28 mixes the color concentrate and liquid dispersant, causing pigment particles to disperse in the liquid and forming liquid toner. A typical mixer operates by providing a tortuous path for the stream of dispersant with injected color concentrate. The resulting toner is applied to a latent image by an applicator 23, part of an electrostatic printer 11 or the like.

A solids separator 63 in fluid communication with drain 31 receives excess toner therefrom and separates out the pigment particles leaving substantially particle free dispersant. Solids separator 63 comprises an electrode 79, a particle accumulating surface, here a belt 81, and scraper blades 95, 97, 99 and 101. Belt 81 is an endless metal belt that turns on pulleys 83 and 85 rotating in the direction indicated by arrows A. In this manner, the belt continually moves past electrode 79 in the direction indicated by arrow B carrying toner along with it and continually presenting a clean surface to electrode 79. Belt 81 and electrode 79 are closely spaced, typically about 30 mil (762 microns) apart, and define a region 87 therebetween. An entrance aperture 89 at one end of region 87 receives excess liquid toner from drain tube or ribbon tube 33. An exit aperture 91 is defined at the opposite end of region 87 from entrance aperture 89 for removing clear liquid dispersant. Electrode 79 is electrically biased by a power supply 93 so as to repel solid pigment particles and drive the particle toward belt 81. Typically, electrode 79 has an electrical potential of about 4 kilovolts relative to belt 81, and acts like a capacitor. Pigment particles deposit and agglomerate on the belt surface to form a layer of color concentrate that is carried by the belt beyond the electrode 79 to the scraper blades 95, 97, 99, 101. As already noted, the remaining substantially particle free liquid dispersant is removed at the exit aperture 91 and returns along return line 65 to supply tank 45. A vent 94 may be provided in solids separator 63 to ensure free flow of fluids and effective aspirator suction.

Scraper blades 95, 97, 99 and 101 are selectively actuated so as to abut belt 81 beyond electrode 79. Color concentrate removed from belt 81 by one of the scraper blades 95, 97, 99 and 101 returns to the appropriate concentrate tank 47, 49, 51 or 53 by way of concentrate return lines 103. For example, tanks 47, 49, 51 and 53 may contain yellow, magenta, cyan and black concentrate respectively. Scraper blade 95 actuates to return yellow concentrate to tank 47. Scraper blade 97 actuates to return magenta concentrate to tank 49. Scraper blade 99 actuates to return cyan concentrate to tank 51. Scraper blade 101 actuates to return black concentrate to tank 53. The number of concentrate tanks and the order of color concentrates may vary from the example given here.

Figure 3:
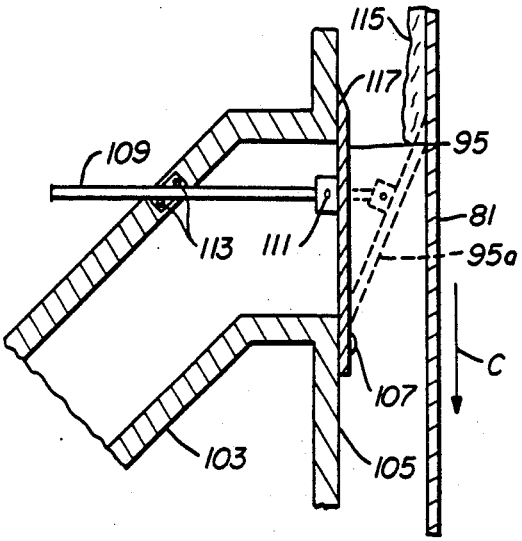
FIG. 3 is an expanded side section of a scraper blade of the solids separator in FIG. 2.

In FIG. 3, a detail of a scraper blade 95 is shown. Other scraper blades 97, 99 and 101 are similarly constructed. Blade 95 is mounted in front of a concentrate return line 103 leading to a tank of concentrate by means of a row of screws 107 inside housing 105 of the solids separator. Blade 95 is hinged to pivot against belt 81, as indicated by phantom blade 95*a* abutting belt 81. An actuating rod 109 is attached to blade 95 at a pivot 111. O-ring seal 113 or the like in a wall of return line 103 prevents possible leakage. Rod 109 is typically solenoid actuated, but mechanical or other actuation means may also be used.

In operation, belt 81 contains a layer 115 of color concentrate and travels in a direction indicated by arrow C. Rod 109 pushes blade 95 into abutment against belt 81, i.e. into the position indicated by phantom blade 95*a*, so as to cause the layer 115 of color concentrate to be scraped off and returned to a tank via return line 103. Blade 95 is typically composed of a spring metal material, such as beryllium-copper alloy. With use, its end 117 abutting against belt 81 is worn flat for more effective scraping action. Withdrawing piston 109 causes blade 95 to close off return line 103, preventing any contamination by other color concentrates.

Figure 4:
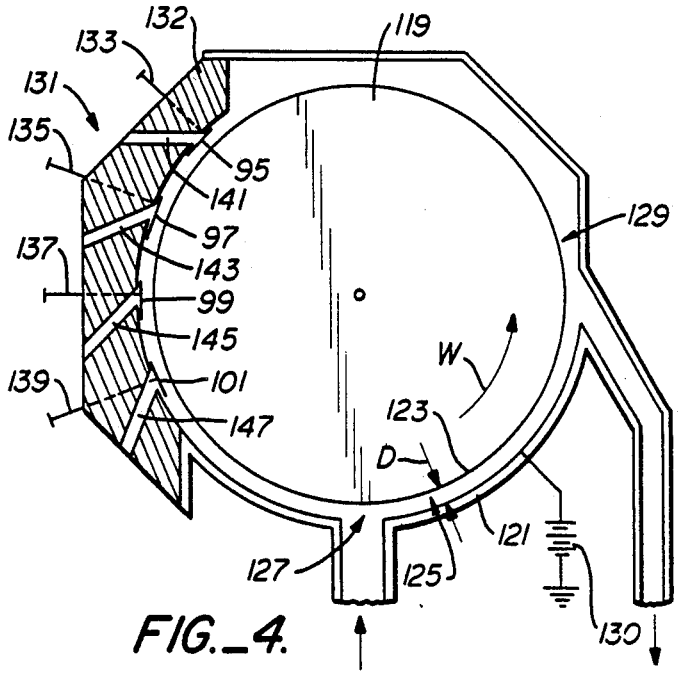
FIG. 4 is an alternate embodiment of a solids separator for use in the system of FIG. 2.

In FIG. 4, an alternate embodiment of solids separator 63 uses a drum 119 instead of belt 81 but otherwise operates in the same manner as the embodiment in FIG. 2. The solids separator has an electrode 121. As drum 119 rotates in the direction indicated by arrow W, the surface 123 of drum 119 moves past electrode 121, carrying liquid toner along in the region 125 between electrode 121 and drum surface 123. Drum surface 123 is spaced from electrode 121 by a small distance indicated by arrows D. Typically, drum 119 has a diameter of about 3 inches (7.6 cm) and a width of about 1.7 inches (4.3 cm). The spacing D between electrode 121 and drum surface 123 is typically about 15 mils (381 microns). At a drum rotation speed of about 400 RPM, liquid toner is pumped or carried past the electrode 121 in the region 125 at an average rate of about 12.6 $cm^3$/sec.

Excess toner is introduced into region 125 at an entrance aperture 127 at one end of region 125, is pumped past electrode 121, and the resulting dispersant with particles separated therefrom is returned to its supply tank at exit aperture 129. A power supply 130 biases electrode 121 to a potential of about 4 kilovolts relative to drum 119 so as to repel solid pigment particles, driving the particles toward drum surface 123. Sufficient separation of particles from dispersant is achieved for electrodes extending over at least a 90 degree arc of the drum. Shorter electrodes may be used with higher bias potentials.

The pigment particles, having been deposited onto drum surface 123 so as to form an agglomerated layer of color concentrate, are removed from the drum surface 123 at a concentrate removal station 131, and returned to the appropriate concentrate tank. Removal station 131 comprises blades 95, 97, 99 and 101 pivotally attached to a block 132 which are selectively pushed into abutment with drum surface 123 by rods 133, 135, 137 and 139. Passages 141, 143, 145 and 147 in block 132 conduct the removed concentrate to the appropriate tank. In construction and operation, removal station 131 is similar to that in FIG. 3, except that the housing 105 and return lines 103 are replaced with block 132 and passages 141, 143, 145 and 147.

With reference to FIG. 5, an alternate embodiment of the toner recycling system of FIG. 2 has a plurality of dedicated solids selectors 151, 153, 155 and 157 instead of one common solids separator. Again, the system includes a dispersant supply subsystem 159, similar to that shown within the dashed lines 160 in FIG. 2, in which dispersant is circulated through lines 160 and 162 from a supply tank to an applicator and back to the supply tank by means of a pump. Tanks of color concentrate 161, 163, 165 and 167 communicate via pumps or valves 169 with a manifold 171 and a mixer 173 where color concentrate is injected and dispersed in the stream of liquid dispersant to form liquid toner. The liquid toner is then applied to a latent image by the applicator 175. Excess toner is collected by a drain 177 and delivered to the appropriate solids separator by a selector foot 39. Each solids separator 151, 153, 155 and 157 includes a particle accumulating surface such as a drum surface 179, and an electrode 181 biased to repel solid pigment particles. Toner is introduced into the region 185 between the electrode 181 and drum surface 179 at an entrance aperture and pumped or carried by the rotating drum to an exit aperture. Substantially particle free dispersant is returned to the supply tank. A fixed scraper blade 187 abuts the drum surface 179 and removes the layer of accumulated toner particles for return to the appropriate supply tank.

Figure 6:
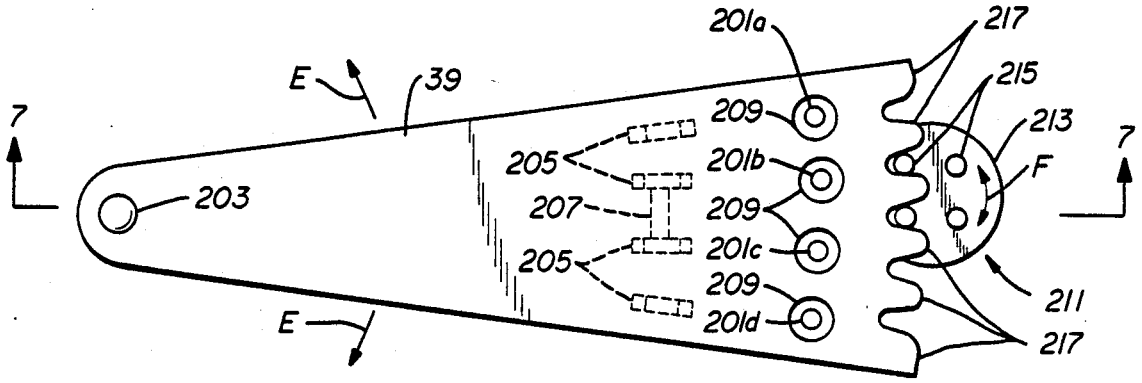
FIG. 6 is a plan view of a drain selector foot for use in the system of FIG. 5.
Figure 7:
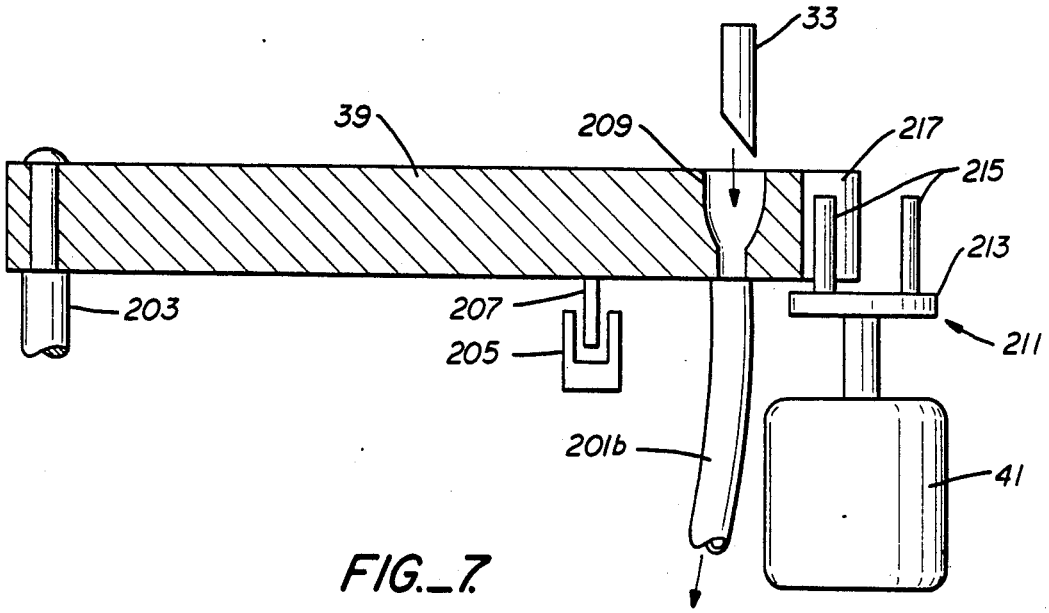
FIG. 7 is a side view of the drain selector foot in FIG. 6.

With reference to FIGS. 6 and 7, a drain selector foot 39 selects a return tube 201*a, b, c* or *d* for directing excess toner to the appropriate dedicated solids separator in FIG. 5. Foot 39 pivots about a post 203 at an end of foot 39 in either counterclockwise or clockwise direction, as indicated by arrows E. The position of foot 39 is indicated by optical sensors 205, each consisting of a light source and detector separated by a narrow space. A flag 207 depending from foot 39 passes through sensors 205 as the foot pivots, activating the sensors in sequence according to the position of the foot. The pivoting foot 39 brings one of four openings 209 into line beneath drain tube 33. Excess toner thus flows from drain tube 33 through an opening 209 and into a return tube 201*a, b, c* or *d* for delivery to a solids separator. Preferably, drain tube 33 is pointed like a quill to prevent drops of toner therein from staying in the drain tube 33.

Foot 39 is driven into a selected position by a peg disk drive 211 powered by a servo motor 41. Peg disk drive 211 comprises a disk 213 and four upstanding pegs 215 projecting from disk 213. Foot 39 has a plurality of toes 217, typically six in number, which extend from an end of foot 39 opposite post 203. The toes 217 define spaces therebetween which receive pegs 215. Disk 213 may turn in either clockwise or counterclockwise direction, as indicated by arrows F. Turning drive 211 forces a peg 215 engaging foot 39 to push against a toe 217, causing foot 39 to pivot. A new peg 215 moves into engagement with foot 39. Turning drive 211 clockwise pivots foot 39 counterclockwise, and vice versa.

The system of the present invention, whether containing one common solids separator or several dedicated solids separators, allows toners to be recycled without diluting the concentration of the applied toner. As a result, the latent image to be developed is consistently toned. The concentration of particles added to the dispersant can be easily controlled for better contrast or color balance. Further, there is no need to dispose of diluted toner, but merely to replace color concentrate and dispersant as it is used up.

I claim:

1. A system for recycling liquid toner comprising, at least one tank of color concentrate containing charge-bearing solid pigment particles, a supply tank of substantially particle-free fluid dispersant, means communicating with said supply tank for supplying a stream of said dispersant from said supply tank, means communicating with said at least one tank of color concentrate for selectively injecting an amount of color concentrate into said stream of dispersant and for mixing said color concentrate into said dispersant to form a stream of a toner fluid, a toner fluid applicator communicating with said injecting and mixing means for receiving said stream of toner fluid and applying said toner fluid to a surface, means disposed with respect to said toner fluid applicator for collecting excess toner fluid from said surface, means communicating with said collecting means for electrically separating said charge-bearing solid pigment particles from said excess toner fluid leaving substantially particle-free fluid dispersant, said means for electrically separating said pigment particles including an electrical biasing source and a particle accumulating surface, said biasing source being in electrical communication with said excess toner fluid to cause said pigment particles to collect on said particle accumulating surface, motion means for moving said particle accumulating surface to a location where said collected pigment particles may be removed therefrom, means for removing said collected pigment particles from the particle accumulating surface, means for returning said substantially particle-free fluid dispersant to said supply tank, and means for returning said pigment particles removed from said particle accumulating surface to said at least one tank of color concentrate from which said particles originally came.

2. The system of claim 1 further comprising means for filtering said substantially particle-free fluid dispersant for any remaining particles prior to returning said dispersant to said supply tank.

3. The system of claim 1 further comprising means for controlling said amount of color concentrate injected into said stream of dispersant.

4. The system of claim 1 wherein said means for electrically separating said pigment particles from said excess toner fluid comprises, an electrode which is electrically biased by said biasing source to repel said pigment particles, said motion means moving said particle accumulating surface past said electrode in closely spaced relation thereto, said electrode and said particle accumulating surface defining a region therebetween, an aperture defined at one end of said region for introducing toner fluid from said excess toner collecting means and an exit aperture defined at the other end for removal of substantially particle-free fluid dispersant for return to said supply tank, pigment particles in said region having been deposited on said particle accumulating surface to form an agglomerated layer, said means for removing removes said agglomerated layer from said particle accumulating surface for return to said at least one tank of color concentrate.

5. The system of claim 4 wherein said particle accumulating surface is a belt.

6. The system of claim 4 wherein said particle accumulating surface is a drum surface.

7. The system of claim 4 wherein said means for removing said layer comprises at least one blade abutting against said particle accumulating surface.

8. A method of separating charge-bearing solid pigment particles from a liquid toner comprising, introducing a liquid toner into a region between an electrode and a particle accumulating surface moving past said electrode, said liquid toner having charge-bearing solid pigment particles dispersed in a substantially particle-free fluid dispersant, depositing onto said particle accumulating surface said pigment particles to form an agglomerated layer containing pigment particles disposed on said particle accumulating surface, said electrode being closely spaced from said particle accumulating surface, said electrode being electrically biased to repel said charge-bearing pigment particles so as to leave a stream of substantially particle-free fluid dispersant flowing next to said electrode, returning said fluid dispersant to a supply tank, removing said agglomerated layer from said particle accumulating surface after said surface containing said layer has moved beyond said electrode, and returning said removed agglomerated layer to a tank for storing concentrate.

9. The method of claim 8 wherein said particles are deposited onto the surface of a belt.

10. The method of claim 8 wherein said particles are deposited onto the surface of a drum.

11. The method of claim 8 wherein motion of said particle accumulating surface carries said liquid toner along past said electrode.

12. The method of claim 8 wherein said agglomerated layer is removed from said particle accumulating surface by scraping said surface with a blade abutting against said surface.

13. A solids separating apparatus for liquid toner comprising, an electrode, a particle accumulating surface which is movable past said electrode, said surface being closely spaced relative to said electrode, a region being defined between said electrode and said surface, an entrance aperture being defined at one end of said region for introducing a toner fluid into said region, said toner fluid comprising charge-bearing solid pigment particles dispersed in a liquid dispersant, said electrode being electrically biased whereby said pigment particles are deposited on said particle accumulating surface in a layer, an exit aperture being defined at the opposite end of said region from said entrance aperture for removal of substantially particle-free liquid dispersant, and means disposed beyond said exit aperture for removing said layer of pigment particles from said particle accumulating surface.

14. The apparatus of claim 13 wherein said particle accumulating surface is a belt.

15. The apparatus of claim 13 wherein said particle accumulating surface is the surface of a rotatable drum.

16. The apparatus of claim 13 wherein said means for removing said layer comprises at least one blade abutting against said particle accumulating surface.

17. A liquid toner recycling system for use in an electrostatic image developing apparatus of the type having a developing station, comprising, a first supply tank having substantially particle-free fluid dispersant, a second supply tank having color concentrate, said color concentrate containing charge-bearing pigment particles, means communicating with said first supply tank for supplying a stream of said dispersant, means communicating with said second supply tank for selectively injecting an amount of color concentrate into said stream of dispersant and for mixing said color concentrate into said dispersant to form a stream of toner fluid supplied to a developing station of an electrostatic image developing apparatus, drain means disposed with respect to the developing station for collecting excess toner fluid from said developing station, means associated with the developing station for electrically separating said charge-bearing pigment particles from said toner fluid thereby producing substantially particle-free fluid dispersant, said means for electrically separating said pigment particles including an electrical biasing source and a particle accumulating surface, said biasing source being in electrical communication with said toner fluid so as to cause said pigment particles to collect on said particle accumulating surface, said particle accumulating surface having means for moving away from said electrical biasing source to a location where collected pigment particles are removed, means for returning said substantially particle-free fluid dispersant to said first supply tank, and means for removing said pigment particles from said particle accumulating surface and for returning said pigment particles to said second supply tank.

18. The recycling system of claim 17 further comprising a third and a fourth supply tank, each containing a color concentrate having charge-bearing pigment particles and each in fluid communication with said means for selectively injecting an amount of color concentrate into the stream of dispersant.

19. The recycling system of claim 17 further comprising means for controlling said amount of color concentrate injected into said stream of dispersant.

20. The recycling system of claim 17 wherein said particle accumulating surface is a belt.

21. The recycling system of claim 17 wherein said particle accumulating surface is a drum surface.

22. In an apparatus having fluid toning of an electrostatic latent image, a toner recycling system comprising, a substantially particle-free fluid dispersant supply tank communicating with means for supplying a stream of dispersant, at least two tanks of color concentrate, said color concentrate having charge-bearing solid pigment particles, each tank selectively communicating with said stream of dispersant for mixing color concentrate into the stream of dispersant, means for collecting excess mixture of color concentrate and dispersant from a supported electrostatic latent image, electrode means for electrically depositing charge-bearing pigment particles from said excess mixture onto a surface thereby separating said solid pigment particles from fluid dispersant, leaving purified dispersant, means for moving said surface with pigment particles thereon away from said electrode means, means for collecting deposited pigment particles from said surface, means for collecting purified dispersant, means for returning said collected deposited pigment particles to said selected color concentrate tank, and means for returning purified dispersant to said dispersant supply tank.

23. The apparatus of claim 22 wherein said surface comprises a moving surface.

24. The apparatus of claim 23 wherein said moving surface comprises an endless belt.

25. The apparatus of claim 24 wherein said means for collecting deposited pigment particles comprises a blade engaged against said endless belt.

26. The apparatus of claim 23 wherein said moving surface comprises a drum surface.

27. The apparatus of claim 26 wherein said means for collecting deposited pigment particles comprises a blade engaged against said drum surface.

28. The apparatus of claim 22 further comprising additional means for electrically depositing charge bearing pigment particles onto corresponding additional surfaces, one surface for each color of color concentrate, thereby separating pigment particles of each color from fluid dispersant.

29. An image toning system comprising, a first tank of color concentrate containing charge-bearing solid pigment particles, a second tank of fluid dispersant which is substantially free of pigment particles, means for combining pigment particles from the first tank with dispersant from the second tank to form a toner fluid, means for applying the toner fluid to a surface to tone an electrostatic image thereon, means for collecting excess toner fluid from the surface, a movable accumulation surface, an electrode closely spaced from the accumulation surface, means for introducing the collected excess toner fluid into a region between the accumulation surface and the electrode, means for applying an electric potential between the electrode and the accumulation surface to cause the charge-bearing pigment particles to adhere to the accumulation surface, and means for moving the accumulation surface with pigment particles thereon away from said electrode means for separation therefrom, means for returning the separated pigment particles to the first tank, and means for returning the substantially particle-free fluid dispersant from the separating means to the second tank.

30. A system for recovering charge-bearing solid pigment particles from a fluid dispersant in a liquid toner comprising, an accumulation surface, an electrode spaced proximate to said accumulation surface, means for introducing the liquid toner into a region between the accumulation surface and the electrode, means for applying an electric potential between the electrode and the accumulation surface to cause the charge-bearing pigment particles to adhere to the accumulation surface, means for moving the accumulation surface away from said electrode to separate the pigment particles adhering thereto from the fluid dispersant in the region between the accumulation surface and the electrode, means for removing the pigment particles from the accumulation surface, means for delivering the pigment particles removed from the accumulation surface to a first supply tank, and means for delivering the fluid dispersant from the region between the accumulation surface and the electrode to a second supply tank.

31. A method of recovering charge-bearing solid pigment particles from a fluid dispersant in a liquid toner comprising, introducing liquid toner into a region between an accumulation surface and an electrode, applying an electric potential between the electrode and the accumulation surface to cause charge-bearing pigment particles in the toner to adhere to the accumulation surface, moving the accumulation surface having particles thereon away from the electrode to separate the pigment particles adhering thereto from fluid dispersant in the region between the accumulation surface and the electrode, removing the pigment particles from the accumulation surface, delivering the pigment particles removed from the accumulation surface to a first supply tank, and delivering the fluid dispersant from the region between the accumulation surface and the electrode to a second supply tank.

* * * * *